US006205696B1

(12) United States Patent
Bilgeri

(10) Patent No.: US 6,205,696 B1
(45) Date of Patent: Mar. 27, 2001

(54) GUN WITH DETACHABLE BARREL MOUNTING

(75) Inventor: Elmar Bilgeri, Steyr (AT)

(73) Assignee: Steyr-Daimler-Puch Aktiengesellschaft, Vienna (AT)

( * ) Notice: Subject to any disclaimer, the term of this patent is extended or adjusted under 35 U.S.C. 154(b) by 0 days.

(21) Appl. No.: 09/214,972

(22) PCT Filed: Jul. 15, 1997

(86) PCT No.: PCT/AT97/00166

§ 371 Date: Jan. 15, 1999

§ 102(e) Date: Jan. 15, 1999

(87) PCT Pub. No.: WO98/02707

PCT Pub. Date: Jan. 22, 1998

(30) Foreign Application Priority Data

Jul. 16, 1996 (AT) ..... 1277/96

(51) Int. Cl.[7] ..... F41A 21/48
(52) U.S. Cl. ..... 42/75.02
(58) Field of Search ..... 42/77, 75.02

(56) References Cited

U.S. PATENT DOCUMENTS 1,065,341 * 6/1913 Browning ..... 42/75.02
2,747,313 * 5/1956 Crittendon et al. ..... 42/75.02
3,805,434 * 4/1974 Sudano ..... 42/77
3,883,977 * 5/1975 McClure ..... 42/75.02
5,501,135 * 3/1996 Beretta ..... 42/75.02
5,540,008 * 7/1996 Kirnstatter ..... 42/75.02
5,630,406 * 5/1997 Dumont ..... 42/75.02
5,666,756 * 9/1997 Moller ..... 42/77
5,706,599 * 1/1998 Knight ..... 42/75.02
5,737,865 * 4/1998 Brandl et al. ..... 42/75.02
5,802,755 * 9/1998 Tortorici et al. ..... 42/75.02
5,907,919 * 6/1999 Keeney ..... 42/75.02
5,987,797 * 11/1999 Dustin ..... 42/75.02

FOREIGN PATENT DOCUMENTS

423677 * 4/1991 (EP) .
0697578 2/1996 (EP) .
6-257991 * 9/1994 (JP) .
WO 98/27399 * 6/1998 (WO) .

* cited by examiner

*Primary Examiner*—Darren W. Ark
(74) *Attorney, Agent, or Firm*—Bachman & LaPointe, P.C.

(57) ABSTRACT

A rifle has a barrel which is mounted detachably in the housing in that pairs of clamping rings (11, 12) are provided between the rear part of the barrel (5) and the inner cylindrical surface (3) of the housing (1), which clamping rings (11, 12) have mutually facing conical surfaces and are pressed axially by a clamping nut (13) against a collar (7) on the barrel (5). Such a barrel mounting can also be used for a housing made of light alloy, with simple production and with production-dependent tolerances and alignment errors being eliminated.

5 Claims, 2 Drawing Sheets

GUN WITH DETACHABLE BARREL MOUNTING

BACKGROUND OF THE INVENTION

The invention relates to a rifle having a barrel which is mounted detachably in the light-alloy breech housing, the rear part of the barrel being surrounded by an inner cylindrical surface of the breech housing. Particularly in the case of repeater rifles, shrink joints or screw connections are normally used to connect the barrel and the breech housing. Shrink joints can be detached only with great difficulty, while screw connections are costly to manufacture. However, above all, screw connections are not suitable for breech housings made of aluminum or light alloys.

In such cases, clamping structures by means of a clamping screw or transverse bolt arranged tangentially in the breech housing are used. However, these require breech housing extensions which are difficult to manufacture and/or weakening longitudinal slots and, furthermore, have the disadvantage of play, resulting from manufacturing tolerances, between the barrel and the housing bore, so that exact alignment of the barrel axis and the housing longitudinal axis is not ensured.

GB 2142125 A admittedly discloses the use of clamping elements for connecting two coaxial surfaces. However, this relates to the joint between a barrel liner and a main barrel which surrounds the latter and, of course, is also composed of steel. The barrel liner is fitted from the rear into a cartridge chamber which has conical wall parts. The clamping elements, which are not slotted, surround an intermediate sleeve which is screwed onto the barrel from the rear, but without tightening the clamping elements. Grubscrews distributed on the circumference are provided for this purpose.

The aim of the present invention is to provide a barrel mounting which avoids these diadvantages and which can also be used for a light-alloy breech housing, with simple production and with production-dependent tolerances and alignment errors being eliminated.

SUMMARY OF THE INVENTION

According to the invention, the foregoing is achieved by at least one externally cylindrical elastic clamping element, which is slotted in the longitudinal direction and is axially loaded by a clamping nut that is arranged in front of the clamping element and is screwed to a thread on the barrel, being provided between the rear part of the barrel and the inner cylindrical surface of the breech housing.

The clamping elements are mass-produced standard parts and are thus very tightly toleranced but nevertheless cheap, so that very accurate centering is possible. On the outside, they rest against the cylindrical inner wall of the breech housing over a large area so that a reliable friction lock can be achieved with a relatively low load on the breech housing. Since the breech housing does not need any slots or expansions for this purpose, it can be produced easily from light alloy. The thread for the clamping nut on the barrel can absorb considerable forces, since the barrel is actually composed of a material which is hardened or heat-treated. The nut is also composed of a high-strength material and thus occupies very little space and is accessible from the front.

In one possible embodiment, the rear part of the barrel has a conical outer surface, and the clamping element is a clamping sleeve which is slotted alternately from the front and rear. Such clamping sleeves are known in machine tools for clamping workpieces having a central bore. They are likewise cheap and very accurate standard parts, with accurately known characteristics, and are particularly simple to fit.

In one preferred embodiment, pairs of clamping rings having mutually facing conical surfaces are arranged between the clamping nut and a collar on the barrel. The friction force and the stress on the breech housing from the inward pressure exerted by the clamping rings can easily be matched to the respective requirements by choosing the numbers of pairs of rings and their coning angle. The collar allows the barrel to be accurately fixed axially.

In particular cases, it is advantageous, for safety, to provide a holding claw as well, which engages through an opening in the housing into a recess or circumferential groove in the barrel. The simple shape of the housing allows such an opening to be incorporated easily, without having to weaken the cross section of the housing.

BRIEF DESCRIPTION OF THE DRAWINGS

The invention will be described in the following text with reference to figures, in which.

DETAILED DESCRIPTION

Figure 1:
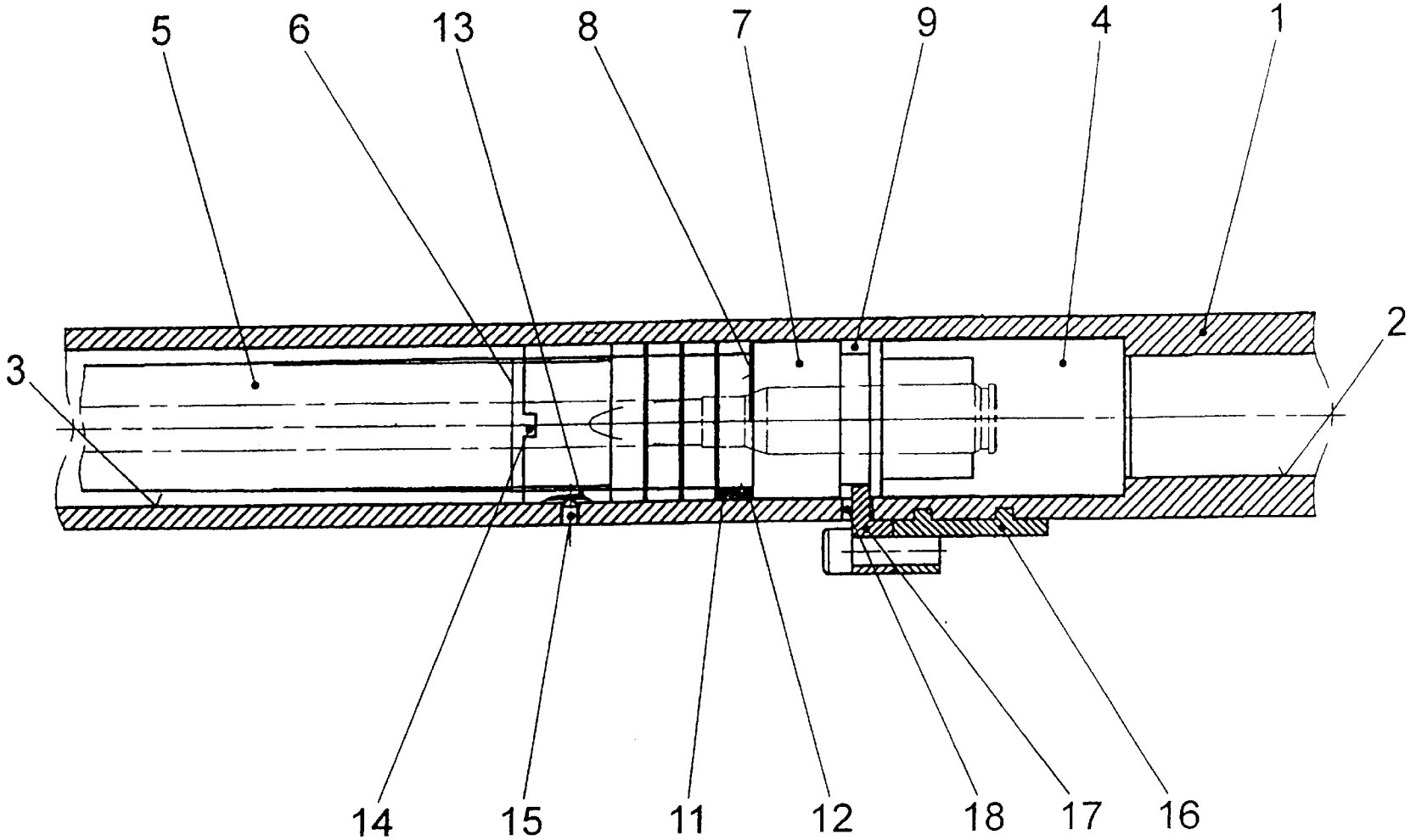
FIG. 1: shows a horizontal section through a part of a first embodiment of a rifle provided with the invention.

FIG. 1 shows a part of the housing, which is denoted by 1. A rear inner wall 2 of smaller diameter represents, for example, the guide for a bolt action (not shown). Adjacent to this, there is a cylindrical inner surface 3 which has a larger diameter and extends forward to the front housing end, which is not illustrated in more detail. Arranged in front of the guide 2 for the breech, there is a space 4 for a locking bush, not shown, which could be screwed to the rear end of the barrel.

A barrel 5 is mounted inside the housing 1, in a manner according to the invention. Only its rear part is shown. A thread which is matched to the rear part of the barrel 5 starts at 6 and extends as far as necessary to the rear, but preferably not as far as a radial annular surface 8 of a collar 7. This collar 7 has a circumferential groove 9, for a purpose which will be described later. The collar 7 can then also be followed by a cartridge chamber wall. The essential features are the thread 6 on the barrel and the collar 7, as well as the cylindrical inner surface 3 of the housing.

In a first embodiment a plurality of clamping rings 11 and an equal number of clamping rings 12 are now provided in order to connect the rear part of the barrel 5 to the housing 1. The clamping rings 11 are slotted, so that they can easily be expanded radially. Their outer envelope surface is cylindrical and their inner envelope surface is conical. The respectively complementary rings 12 may be slotted, have a cylindrical inner surface, and have a conical outer surface at the same angle as the rings 11. The number of such pairs of rings can be chosen in accordance with the requirements. Adjacent to this at the front there is a clamping nut 13 which can be screwed onto the thread 6 of the barrel 5 and presses the clamping rings 11, 12 against the annular surface 8 of the collar 7. In the process, the clamping rings 11 expand, with their cylindrical surfaces being pressed against the cylindrical surfaces of the barrel and housing. They produce a friction-locked joint which is fixed and accurate both with respect to the barrel and with respect to the housing. At the front, the clamping nut 13 also has recesses 14 for a pipe wrench, and can be secured by means of a threaded pin 15.

Finally, a bearing block 16 is also shown on the outside of the housing 1, to which a holding claw 17 is screwed. This holding claw 17 engages through an opening 18 in the housing 1 into the groove 9 in the collar 7.

Figure 2:
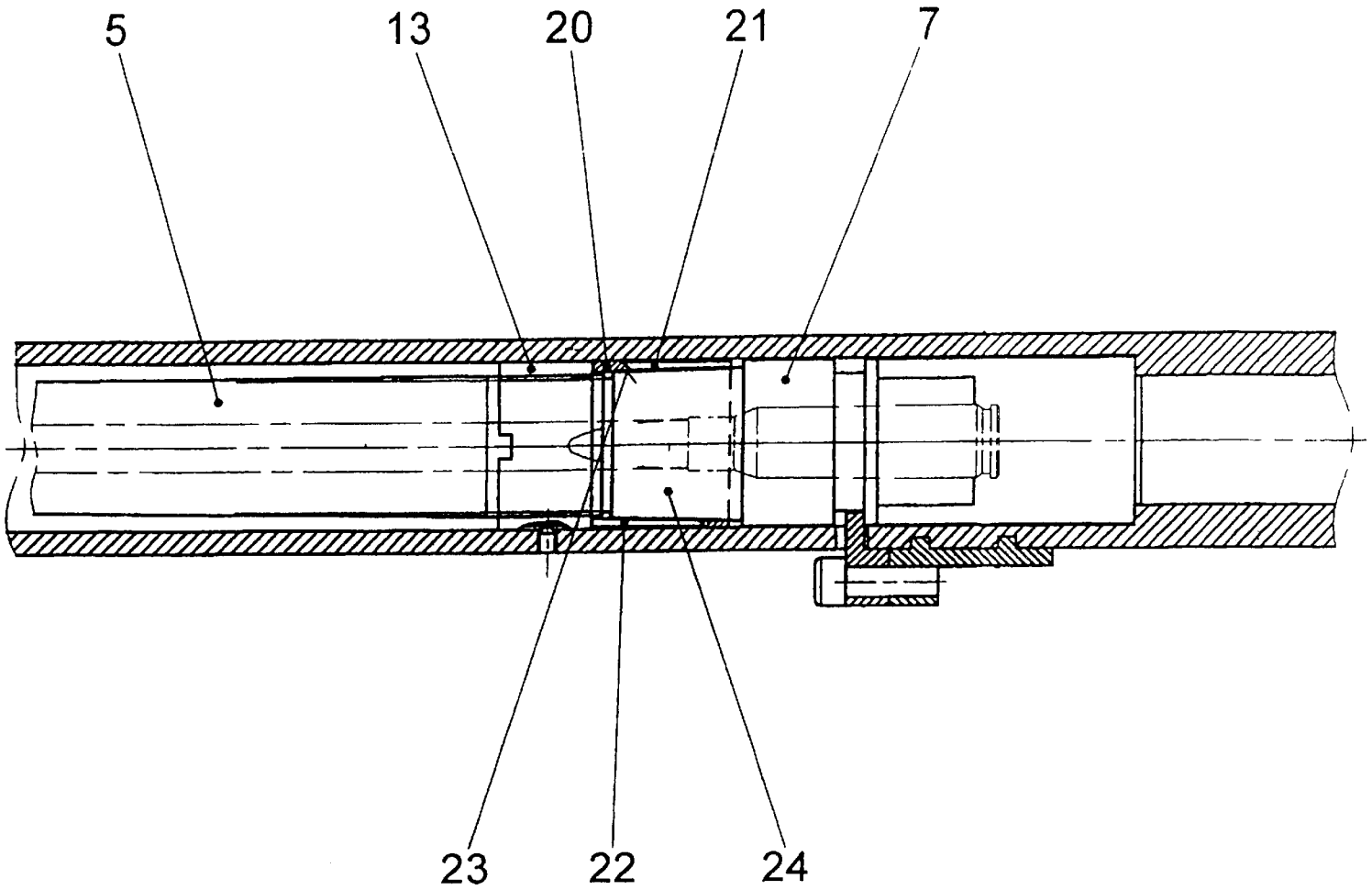
FIG. 2: is as FIG. 1, but showing a second embodiment.

FIG. 2 shows another embodiment, in which identical parts have the same reference symbols. This differs from the previous embodiment in that a clamping sleeve 20 is provided instead of the pairs of rings 11, 12. This clamping sleeve is constructed in the manner known from arbors in machine tool construction: it has slots 21, 22 which are positioned alternately from the front and rear over a large portion of its length, giving it the capability to expand radially, and has a conical inner wall 23, which is seated on a likewise conical outer surface 24 of the barrel. Instead of pushing it against a stop, the clamping nut 13 pushes it onto the conical outer surface of the barrel 24 and, in the process, causes it to expand. Once again, this produces a firm friction-locked joint.

What is claimed is:

1. A rifle comprises:

a light-alloy breech housing having an inner cylindrical surface;

a barrel having a rear part detachably mounted in the inner cylindrical surface of the housing along a longitudinal axis wherein a portion of the rear part is threaded;

at least one elastic clamping element located on the rear part of the barrel between the barrel and the inner cylindrical surface of the housing, the at least one elastic clamping element having at least one slot extending in the direction of the longitudinal axis; and a clamping nut threaded on the threaded portion of the barrel for axially loading the at least one elastic clamping element for fixedly securing the barrel in the housing against axial movement.

2. A rifle according to claim 1 wherein a further portion of the rear part of the barrel has a conical outer surface, and the at least one clamping element is a clamping sleeve which has at least two slots alternately on the front and on the rear and has a conical inner wall.

3. A rifle according to claim 2 wherein a holding claw engages a groove in the barrel through an opening in the breech housing.

4. A rifle according to claim 1 wherein the at least one clamping element comprises a pair of clamping rings having mutually facing conical surfaces arranged between the clamping nut and a collar on the barrel.

5. A rifle according to claim 4 wherein a holding claw engages a groove in the barrel through an opening in the breech housing.

* * * * *